US008069533B2

(12) United States Patent
Yu et al.

(10) Patent No.: US 8,069,533 B2
(45) Date of Patent: Dec. 6, 2011

(54) COUPLING DEVICE FOR A BABY CRIB FRAME STRUCTURE

(75) Inventors: Fu-Sian Yu, Taipei (TW); Chih-Wei Wang, Taipei (TW)

(73) Assignee: Excellerate Enterprise Co., Ltd., Taipei (TW)

( * ) Notice: Subject to any disclaimer, the term of this patent is extended or adjusted under 35 U.S.C. 154(b) by 277 days.

(21) Appl. No.: 12/426,591

(22) Filed: Apr. 20, 2009

(65) Prior Publication Data

US 2009/0260184 A1 Oct. 22, 2009

(30) Foreign Application Priority Data

Apr. 21, 2008 (CN) ..... 2008 2 0112506 U

(51) Int. Cl.
*E05D 11/10* (2006.01)

(52) U.S. Cl. ..... 16/326; 5/99.1

(58) Field of Classification Search ..... 16/325–326; 5/99.1, 93.1, 98.1; 403/102
See application file for complete search history.

(56) References Cited

U.S. PATENT DOCUMENTS

| | | | | |
|---|---|---|---|---|
| 5,745,954 | A * | 5/1998 | Shogan et al. | 16/343 |
| 5,761,755 | A * | 6/1998 | Huang | 5/99.1 |
| 6,223,366 | B1 * | 5/2001 | Cheng | 5/99.1 |
| 6,385,800 | B1 * | 5/2002 | Chen et al. | 5/99.1 |
| 7,043,779 | B2 * | 5/2006 | Mendenhall et al. | 5/99.1 |
| 2007/0186344 | A1 * | 8/2007 | Cheng | 5/99.1 |

* cited by examiner

*Primary Examiner* — Victor Batson
*Assistant Examiner* — Matthew Sullivan
(74) *Attorney, Agent, or Firm* — Banner & Witcoff, Ltd.

(57) ABSTRACT

A coupling device is adapted to be connected foldably to a pair of frame rods of a baby crib frame structure. The coupling device includes a coupling seat, two rod coupling components adapted to be connected respectively to the frame rods and coupled movably to the coupling seat, two locking components connected movably to the coupling seat for preventing and permitting movement of the rod coupling components, and a release unit. The release unit includes a linking component extending between the locking components and formed with two guide holes, a pair of coupling pins extending respectively through and movable respectively along the guide holes and connected respectively to the locking components, and a biasing member. The linking component is movable from an initial position to drive movement of the locking components to permit movement of the rod coupling components, and is biased by the biasing member to the initial position.

9 Claims, 11 Drawing Sheets

COUPLING DEVICE FOR A BABY CRIB FRAME STRUCTURE

CROSS-REFERENCE TO RELATED APPLICATION

This application claims priority of Chinese Application No. 200820112506.1, filed on Apr. 21, 2008.

BACKGROUND OF THE INVENTION

1. Field of the Invention

The invention relates to a coupling device, more particularly to a coupling device for a baby crib frame structure.

2. Description of the Related Art

A baby crib frame structure consists of a plurality of frame rods and a plurality of couplers, each of the couplers interconnecting two frame rods such that the frame rods are pivotable relative to the coupler between a folded state and an unfolded state. A conventional coupler can be operated to maintain the frame rods that are connected thereto at the unfolded state, and to permit pivot movement of the frame rods from the unfolded state to the folded state. Through the folding control function of the couplers, the baby crib frame structure can be folded to save storage space when not in use. Examples of conventional couplers for baby crib frame structures are disclosed in U.S. Pat. No. 5,857,229, U.S. Pat. No. 5,964,545, and US 2007/0079441.

SUMMARY OF THE INVENTION

The object of the present invention is to provide a coupling device for a baby crib frame structure that has a simple structure and that is easy to use.

Accordingly, a coupling device of the present invention is adapted to be connected foldably between a pair of frame rods of a baby crib frame structure. Each of the frame rods has a connecting end. The coupling device comprises a coupling seat, a pair of rod coupling components, a pair of locking components, and a release unit. Each of the rod coupling components is adapted to be connected to the connecting end of a respective one of the frame rods. The rod coupling components are coupled movably to the coupling seat and are movable relative thereto between a first position corresponding to an unfolded state of the frame rods, and a second position corresponding to a folded state of the frame rods. The locking components are connected pivotally to the coupling seat and are movable relative to the coupling seat between a locking position, where each of the locking components prevents movement of a respective one of the rod coupling components from the first position to the second position, and an unlocking position, where each of the locking components permits movement of the respective one of the rod coupling components from the first position to the second position. The release unit includes a linking component, a pair of coupling pins, and a biasing member. The linking component extends between the locking components and is formed with two spaced apart elongated guide holes that are respectively adjacent to the locking components. Each of the coupling pins extends through and is movable along a respective one of the guide holes and is connected to a respective one of the locking components. The linking component is movable relative to the coupling seat from an initial position to an operated position, where the linking component drives movement of the locking components through the coupling pins from the locking position to the unlocking position. The biasing member is for biasing the linking component to the initial position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
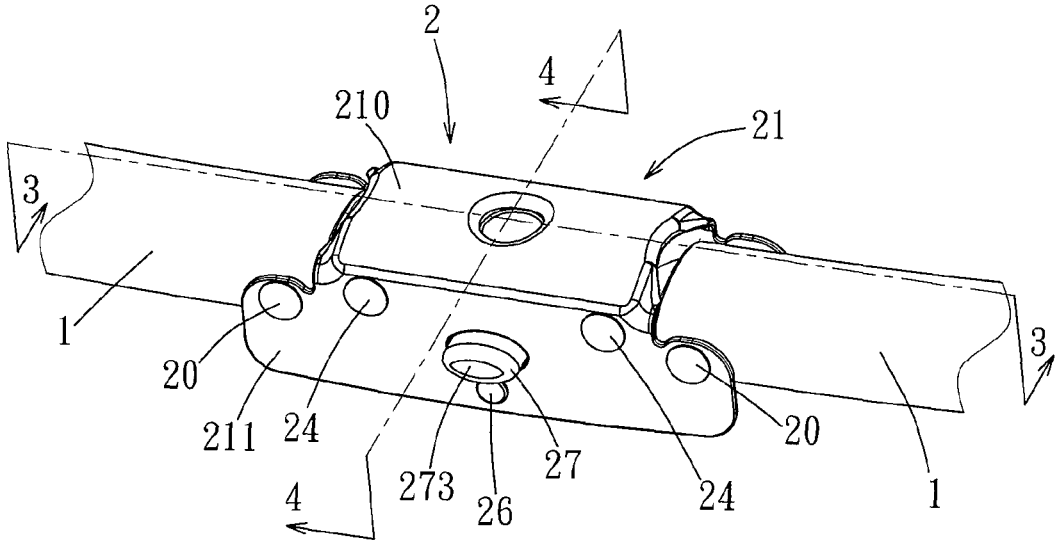
FIG. 1 is an assembled perspective view of a first preferred embodiment of a coupling device for a baby crib frame structure according to the invention.

Before the present invention is described in greater detail, it should be noted that like elements are denoted by the same reference numerals throughout the disclosure.

Figure 2:
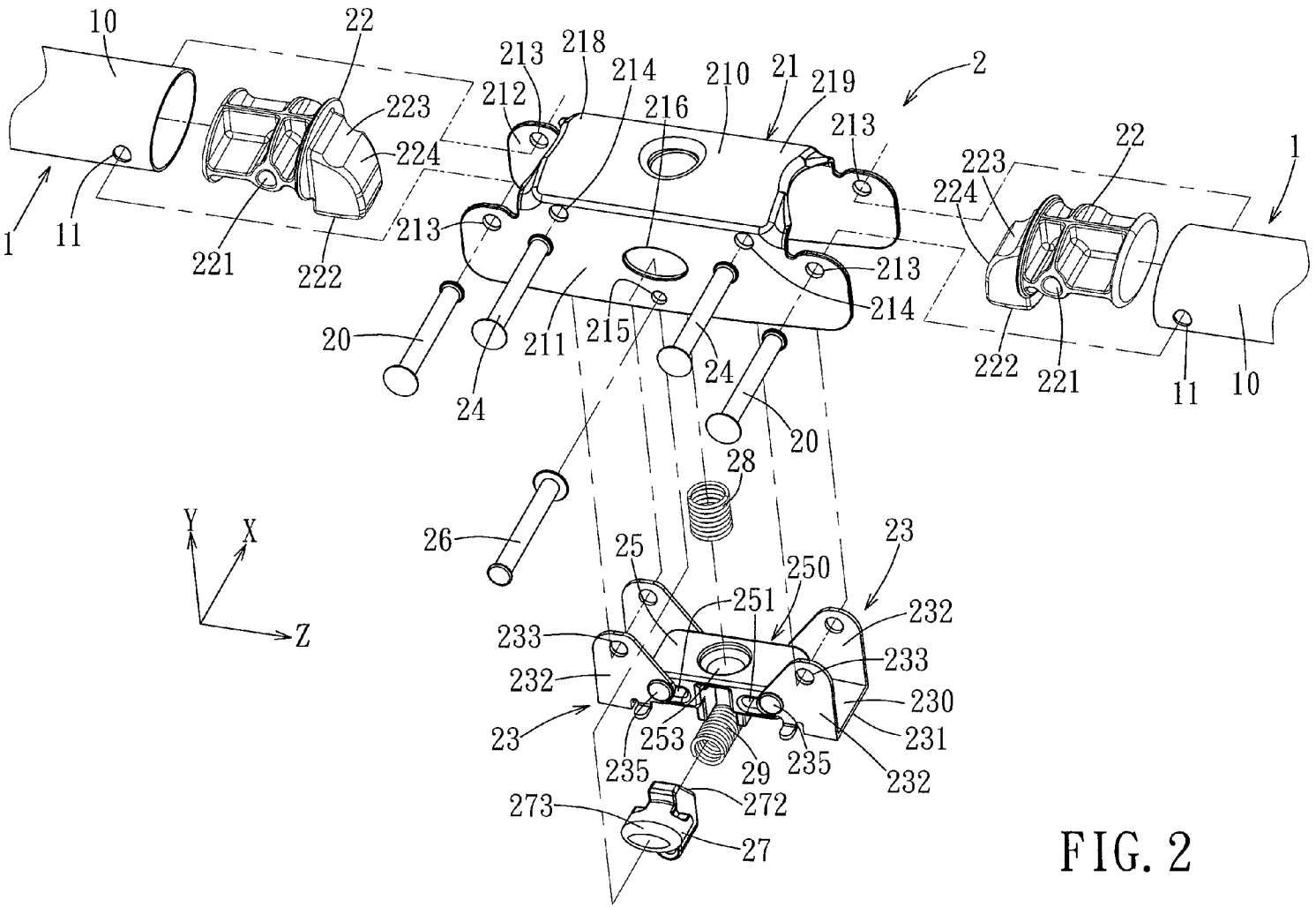
FIG. 2 is an exploded perspective view of the first preferred embodiment.

As shown in FIGS. 1 and 2, the first preferred embodiment of a coupling device 2 according to the present invention is adapted to be connected foldably between a pair of frame rods 1 of a baby crib frame structure. Each of the frame rods 1 has a connecting end 10 that is formed with radially opposite coupling holes 11. The coupling device 2 comprises a coupling seat 21, a pair of rod coupling components 22, each of which is adapted to be connected to the connecting end 10 of a respective one of the frame rods 1 and is coupled movably to the coupling seat 21, a pair of locking components 23 disposed in the coupling seat 21 and connected pivotally to the coupling seat 21, and a release unit 250 disposed in the coupling seat 21.

Figure 3:
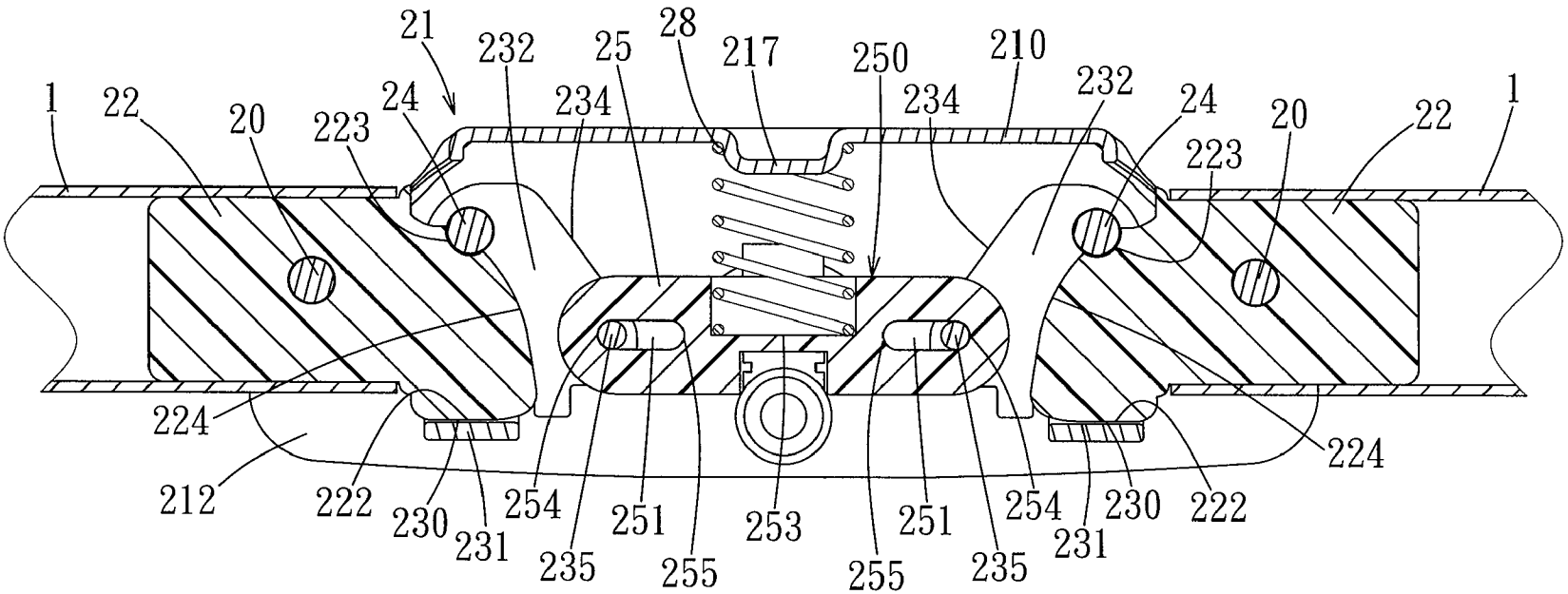
FIG. 3 is a sectional view of the first preferred embodiment taken along line 3-3 in FIG. 1, illustrating each of two locking components at a locking position.
Figure 4:
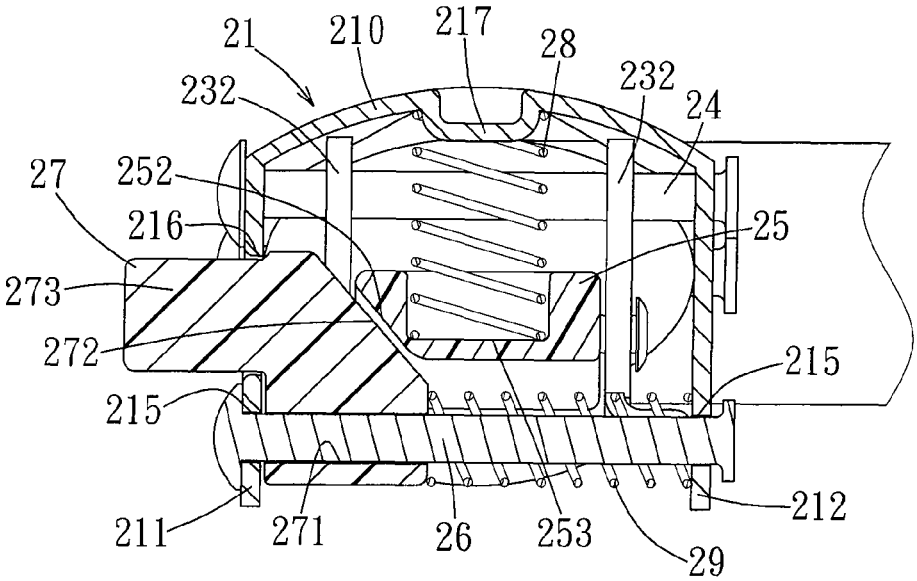
FIG. 4 is another sectional view of the first preferred embodiment taken along line 4-4 in FIG. 1, illustrating a linking component at an initial position.

As shown in FIGS. 2 to 4, the coupling seat 21 is a hollow inverted-U-shaped structure with a pair of symmetrical seat parts 218, 219. The coupling seat 21 has a pair of parallel side walls 211, 212 extending between the seat parts, and a top wall 210 interconnecting the side walls 211, 212. Each of the seat parts 218, 219 has a pair of aligned axle holes 213 that are formed respectively at the side walls 211, 212, a pair of aligned first pin holes 214 that are formed respectively at the side walls 211, 212, and a pair of second pin holes 215 that are formed respectively at the side walls 211, 212. The side wall 211 is further formed with an opening 216.

Each of the rod coupling components 22 is partly inserted into the connecting end 10 of a respective one of the frame rods 1 and has a positioning hole 221 aligned with the coupling holes 11 in the respective one of the frame rods 1. Each of the rod coupling components 22 further has a connecting part having a contact surface 222, a recess 223 that is formed at upper end opposite to the contact surface 222, and a cam surface 224 that is formed between the contact surface 222 and the recess 223.

The coupling seat 21 is provided with a pair of pivot axles 20, each of which is disposed fixedly between the side walls 211, 212 and extends through the pair of axle holes 213 in a respective one of the seat parts 218, 219 of the coupling seat 21, the coupling holes 11 of the connecting end 10 of a respective one of the frame rods 1, and the positioning hole 221 in a respective one of the rod coupling components 22 for connecting pivotally the respective one of the rod coupling components 22 to the coupling seat 21. By virtue of the pivot axles 20, each of the rod coupling components 22 is movable relative to the coupling seat 21 between a first position (see FIG. 3) corresponding to an unfolded state of the frame rods 1, and a second position (see FIG. 8) corresponding to a folded state of the frame rods 1.

Each of the locking components 23 is U-shaped, is made of metal or hard material, and has a pair of parallel side plates 232, a connecting plate 231 that interconnects the side plates 232 and that is formed with an abutment surface 230, and a pair of aligned pivot holes 233 that are formed respectively at the side plates 232.

Figure 6:
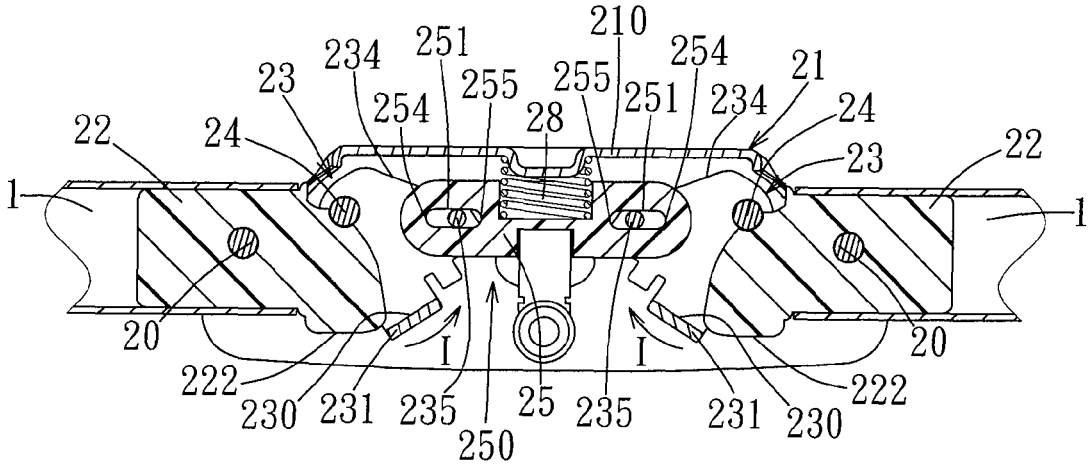
FIG. 6 is a view similar to FIG. 3, but illustrating each of the locking components at an unlocking position.
Figure 7:
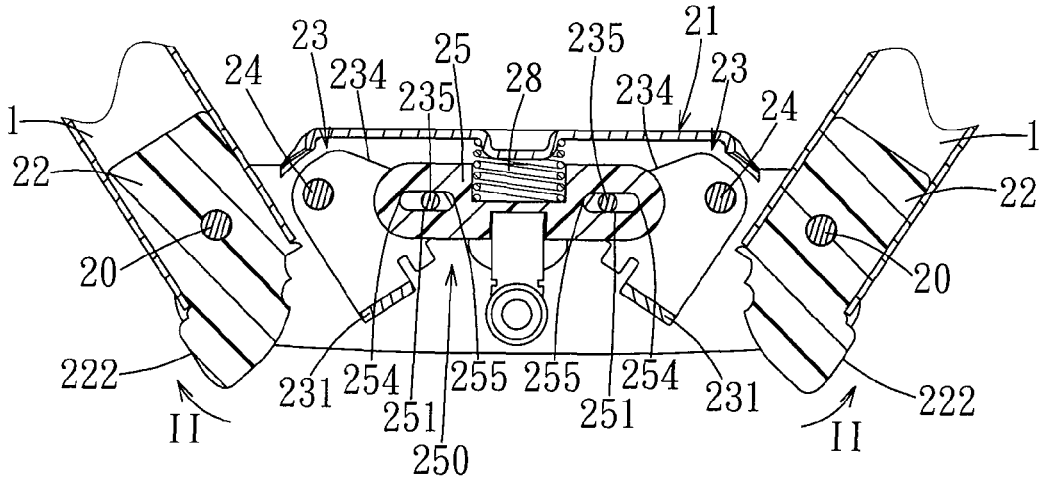
FIG. 7 is view similar to FIG. 6, but illustrating each of two coupling components moved from a first position toward a second position.

The coupling seat 21 is further provided with a pair of pivot pins 24, each of which is disposed fixedly between the side walls 211, 212 and extends through the pair of first pin holes 214 in a respective one of the seat parts 218, 219 of the coupling seat 21, and the pivot holes 233 in a respective one of the locking components 23 for connecting pivotally the respective one of the locking components 23 to the coupling seat 21. By virtue of the pivot pins 24, each of the locking components 23 is movable relative to the coupling seat 21 between a locking position (see FIG. 3), where each of the locking components 23 prevents movement of a respective one of the rod coupling components 22 from the first position to the second position, and an unlocking position (see FIGS. 6 and 7), where each of the locking components 23 permits movement of the respective one of the rod coupling components 22 from the first position to the second position. As best shown in FIG. 3, the abutment surface 230 of the connecting plate 231 of each of the locking components 23 abuts against the contact surface 222 of the respective one of the rod coupling components 22 to lock the respective one of the rod coupling components 22 at the first position when the locking component 23 is at the locking position. The recess 223 in each of the rod coupling components 22 is disposed for holding removably a respective one of the pivot pins 24 when the rod coupling components 22 are at the first position.

Figure 5:
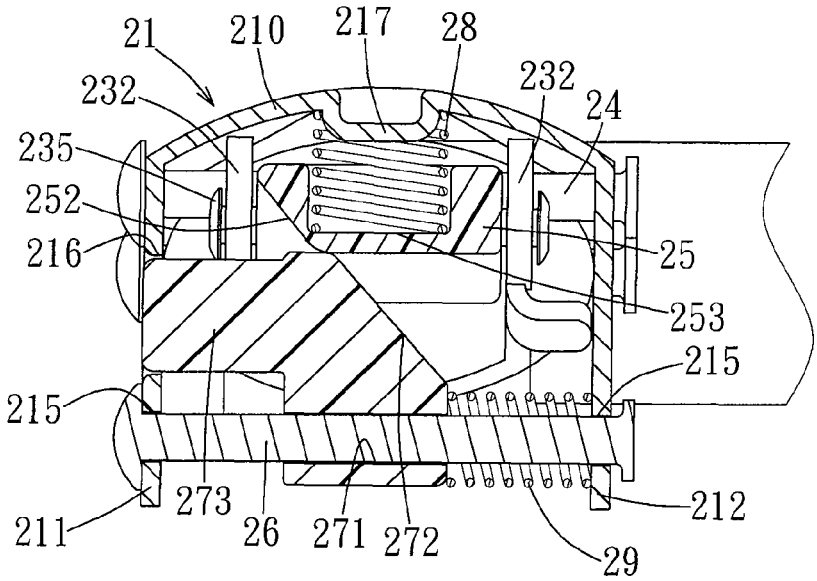
FIG. 5 is a view similar to FIG. 4, but illustrating the linking component at an operated position.

The release unit 250 includes a linking component 25, a pair of coupling pins 235, a biasing member 28, and an urging member 29. The linking component 25 extends between the locking components 23 and is formed with two spaced apart elongated guide holes 251 that are respectively adjacent to the locking components 23. Each of the guide holes 251 has opposite first and second hole ends 254, 255. The first hole ends 254 are distal from each other, while the second holes ends 255 are proximate to each other. Each of the coupling pins 235 extends through and is movable along a respective one of the guide holes 251, and has opposite ends connected respectively to the side plates 232 of a respective one of the locking components 23. The linking component 25 is movable relative to the coupling seat 21 from an initial position (see FIG. 4) to an operated position (see FIG. 5), where the linking component 25 drives movement of the locking components 23 through the coupling pins 235 from the locking position to the unlocking position. In this embodiment, as shown in FIG. 2, each of the coupling pins 235 extends along a first direction (X), the linking component 25 is movable relative to the coupling seat 21 along a second direction (Y) transverse to the first direction (X), and each of the guide holes 251 extends along a third direction (Z) transverse to the first and second directions (X, Y). In addition, each of the side plates 232 of each of the locking components 23 further has an inclined edge 234 with one end adjacent to the respective one of the pivot pins 24 and an opposite end adjacent to the respective one of the coupling pins 235, thereby enabling the locking component 23 to pivot about the respective one of the pivot pins 24 relative to the coupling seat 21.

The coupling seat 21 is further provided with a button mounting pin 26 that extends through the second pin holes 215 and that is disposed fixedly between the side walls 211, 212. The release unit 250 further includes a button component 27 movable along the button mounting pin 26 for driving movement of the linking component 25 from the initial position to the operated position. In this embodiment, the linking component 25 of the release unit 250 is formed with a first inclined surface 252. The button component 27 has a through hole 271 through which the button mounting pin 26 extends, an operating portion 273 that is movably retained in the opening 216 of the coupling seat 21, and a second inclined surface 272 that abuts slidably against the first inclined surface 252 such that movement of the button component 27 along the button mounting pin 26 results in movement of the linking component 25 between the initial and operated positions.

In this embodiment, the top wall 210 of the coupling seat 21 has a protrusion 217 protruding toward the linking component 25, and the linking component 25 is further formed with a retaining recess 253 aligned with the protrusion 217 in the second direction (Y). The biasing member 28 is a coil spring disposed in the coupling seat 21, and has opposite ends abutting respectively against the protrusion 217 of the coupling seat 21 and the retaining recess 253 in the linking component 25 for biasing the linking component 25 to the initial position. The urging member 29 is a coil spring sleeved on the button mounting pin 26, and has opposite ends abutting respectively against the coupling seat 21 and the button component 27 for biasing the button component 27 such that the operating portion 273 projects outwardly of the coupling seat 21 via the opening 216.

As shown in FIGS. 3 and 4, when the frame rods 1 are at the unfolded state, the button component 27 of the coupling device 2 is biased by the urging member 29 of the release unit 250 to abut against the inner surface of the side wall 211 of the coupling seat 21 with the operating portion 273 thereof projecting outwardly of the coupling seat 21 via the opening 216. At this time, the linking component 25 is at the initial position, the coupling pins 235 of the release unit 250 are disposed in the first hole ends 254 of the guide holes 251 in the linking component 25, the recess 223 in each of the rod coupling components 22 holds the respective one of the pivot pins 24, and each of the locking components 23 is at the locking position to retain the respective one of the rod coupling components 22 at the first position.

Referring to FIGS. 5 to 8, when the operating portion 273 of the button component 27 is pressed to move the button component 27 along the button mounting pin 26, the sliding movement between the second inclined surface 272 of the button component 27 and the first inclined surface 252 of the linking component 25 of the release unit 250 pushes the linking component 25 to move from the initial position to the operated position, such that each of the coupling pins 235 is driven to move in the respective one of the guide holes 251 in the linking component 25 from the first hole end 254 toward the second hole end 255, thereby driving the locking components 23 to pivot respectively about the pivot pins 24 in directions (I) (as indicated by the arrows in FIG. 6) from the locking position to the unlocking position. Therefore, the rod coupling components 22 are permitted to pivot respectively about the pivot axles 20 in directions (II) (as indicated by the arrows in FIG. 7) from the first position to the second position, and the user can move the frame rods 1 from the unfolded state to the folded state. When the frame rods 1 are at the folded state, the button component 27 is released such that the restoring force of the urging member 29 biases the button component 27 back to its original position, and that the restoring force of the biasing member 28 biases the linking component 25 back to the initial position, thereby driving the locking components 23 to move back to the locking position.

Figure 8:
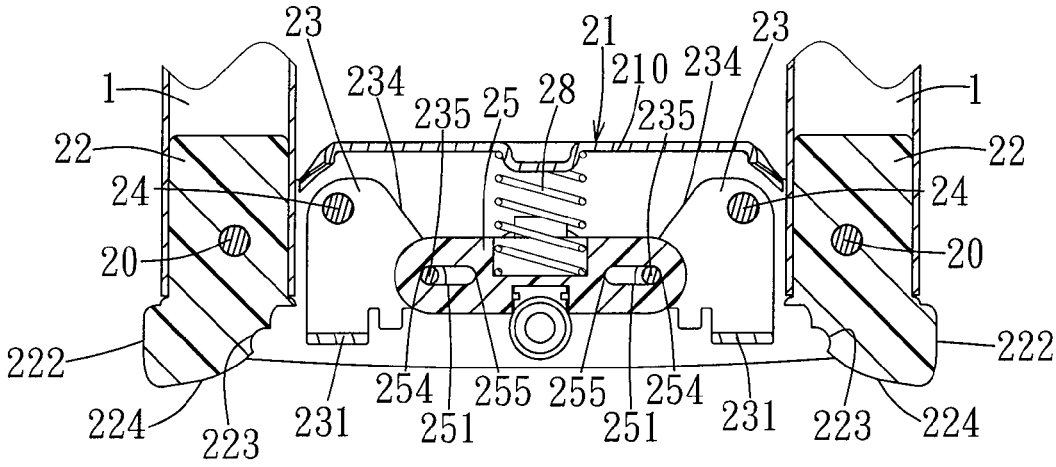
FIG. 8 is another view similar to FIG. 3, but illustrating each of the coupling components at the second position.
Figure 9:
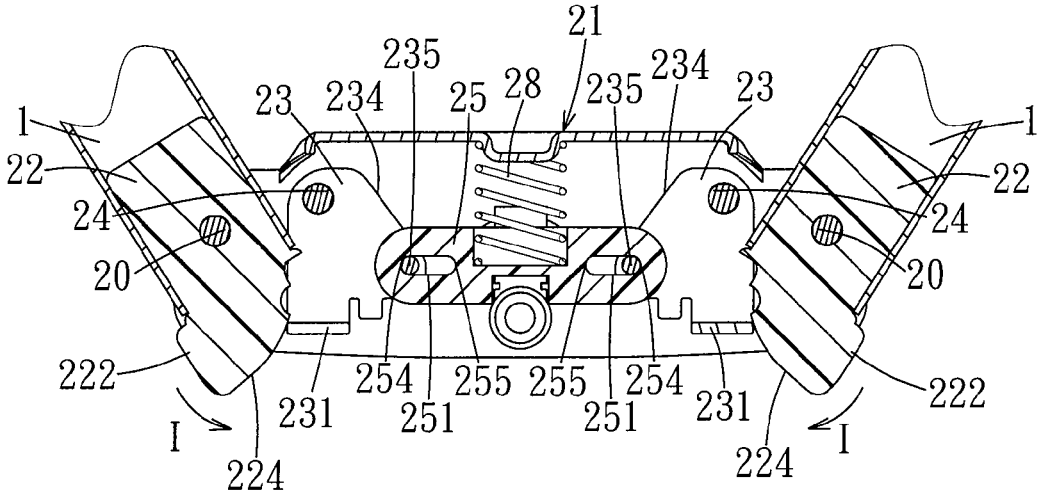
FIG. 9 is a view similar to FIG. 8, but illustrating each of the coupling components moved from the second position toward the first position.

When the user moves the frame rods 1 from the folded state to the unfolded state, as best shown in FIGS. 8 and 9, the rod coupling components 22 are moved respectively along with the frame rods 1 from the second position to the first position in the directions (I) (as indicated by arrows in FIG. 9), and the cam surface 224 of each of the rod coupling components 22 abuts slidably against the connecting plate 231 of the respective one of the locking components 23 for driving the respective one of the locking components 23 to move from the locking position to the unlocking position, thereby moving the linking component 25 to the operated position and compressing the biasing member 28. When the rod coupling components 22 are moved back to the first position, the recess 223 in each of the rod coupling components 22 holds the respective one of the pivot pins 24, and the cam surface 24 of each of the rod coupling components 22 separates from the connecting plate 231 of the respective one of the locking components 23. Afterward, the restoring force of the biasing member 28 biases the linking component 25 to the initial position, thereby driving the locking components 23 back to the locking position.

Therefore, the frame rods 1 can be easily folded through the coupling device 2 of the invention by moving the linking component 25 to drive the locking components 23 from the locking position to the unlocking position, and can be easily unfolded by moving the locking components 23 from the locking position to the unlocking position.

Figure 10:
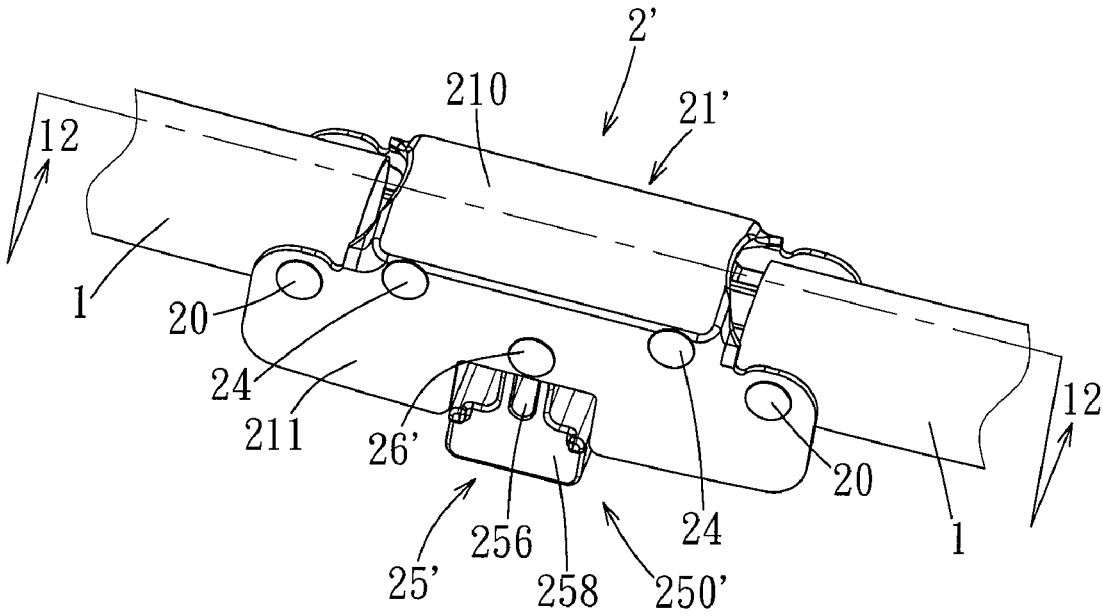
FIG. 10 is an assembled perspective view of a second preferred embodiment of a coupling device for a baby crib frame structure according to the invention.
Figure 11:
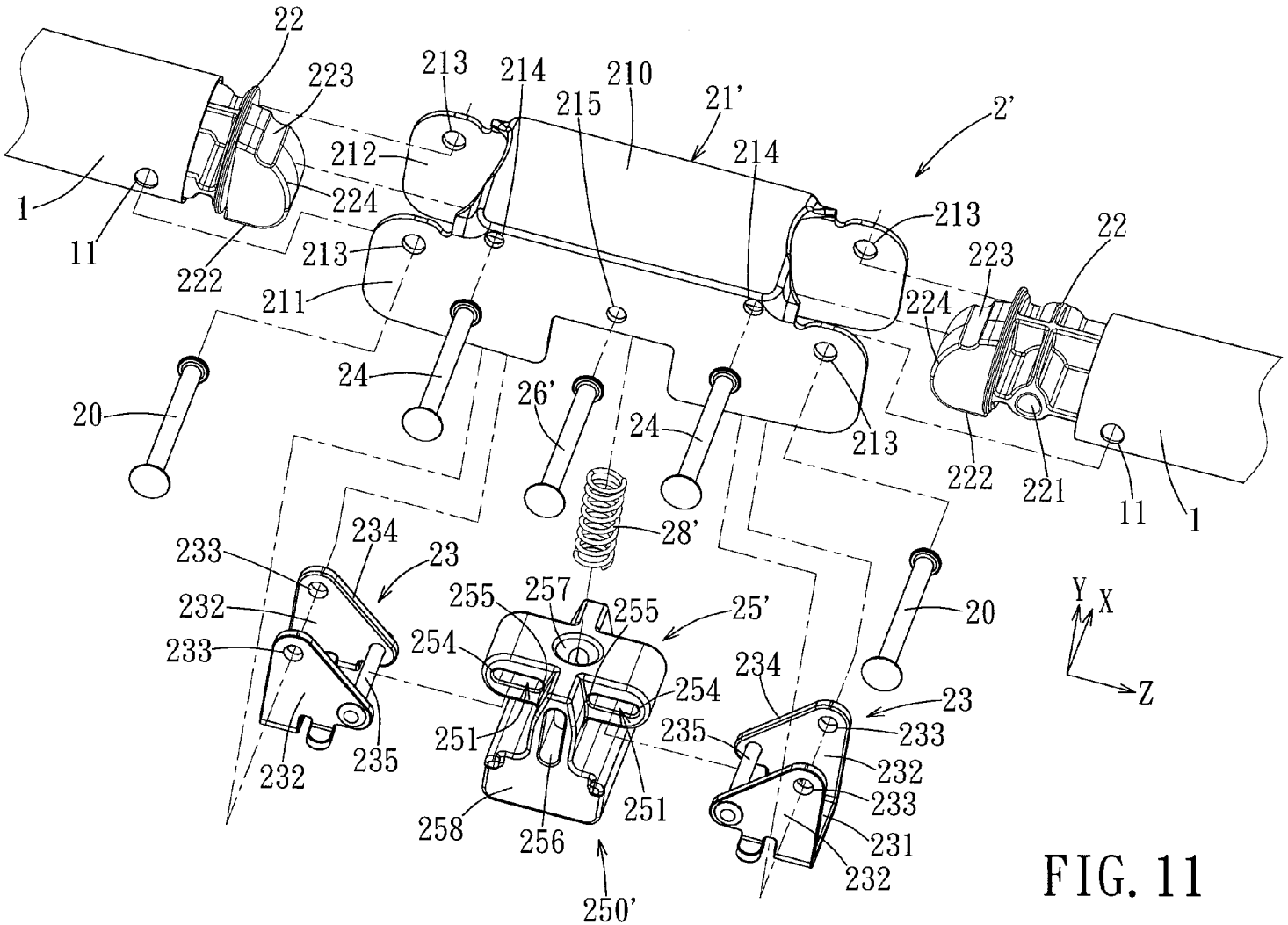
FIG. 11 is an exploded perspective view of the second preferred embodiment.
Figure 12:
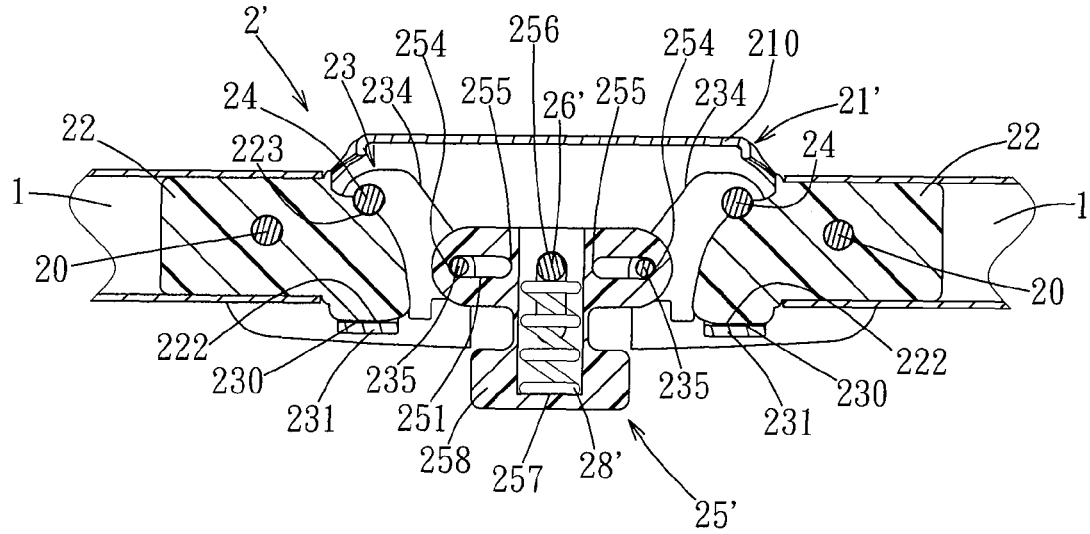
FIG. 12 is a sectional view of the second preferred embodiment taken along line 12-12 in FIG. 10, illustrating each of the locking components at the locking position.

As shown in FIGS. 10 to 12, the second preferred embodiment of the coupling device according to the present invention has a structure similar to that of the first embodiment. The main difference between this embodiment and the previous embodiment resides in the following. The coupling device 2' of this preferred embodiment has a coupling seat 21' that is provided with a component mounting pin 26', and a release unit 250' that includes a linking component 25'. The linking component 25' is formed with an elongated slot 256 that extends along the second direction (Y), and a receiving groove 257 that extends along the second direction (Y) and that is in spatial communication with the elongated slot 256, and is formed with an operating portion 258 adapted for exertion of an external force thereon. The component mounting pin 26' is disposed fixedly between the side walls 211, 212 of the coupling seat 21', and extends through the elongated slot 256 to guide movement of the linking component 25' between the initial and operated positions. The releasing unit 250' has a biasing member 28' provided in the receiving groove 257 between the component mounting pin 26' and the linking component 25'.

When the frame rods 1 are at the unfolded state, the linking component 25' is biased by the biasing member 28' to the initial position, the coupling pins 235 of the release unit 250' are disposed in the first hole ends 254 of the guide holes 251 in the linking component 25', the recess 223 in each of the rod coupling components 22 holds the respective one of the pivot pins 24, and each of the locking components 23 is at the locking position to retain the respective one of the rod coupling components 22 at the first position.

Figure 13:
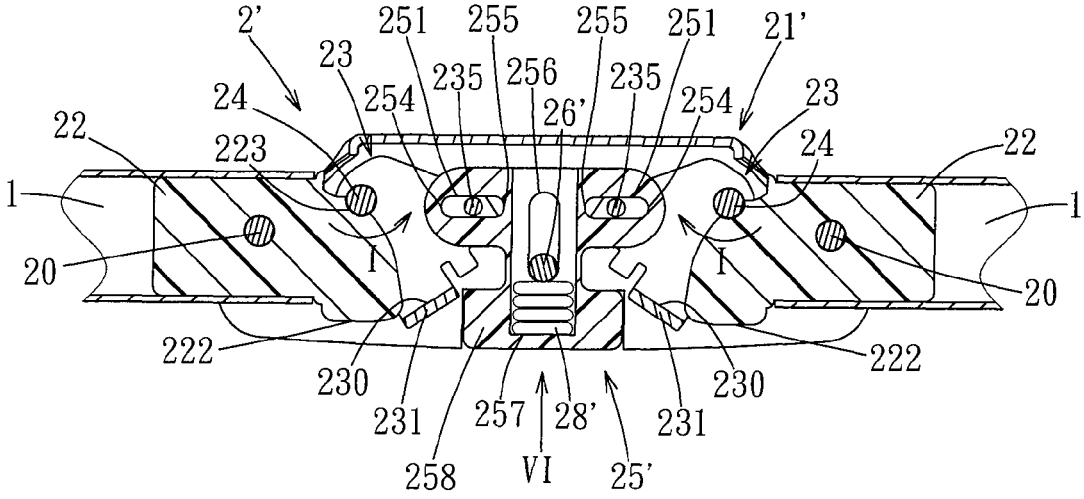
FIG. 13 is a view similar to FIG. 12, but illustrating each of the locking components at an unlocking position.
Figure 14:
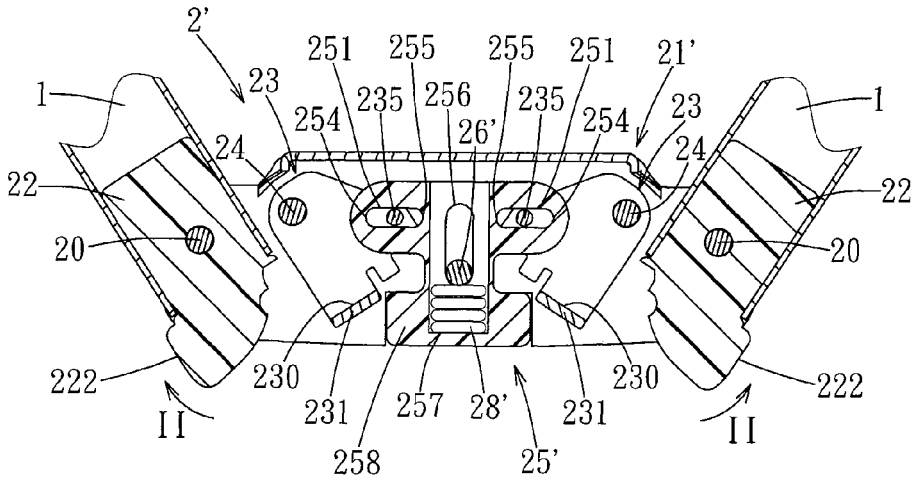
FIG. 14 is a view similar to FIG. 13, but illustrating each of the coupling components moved from the first position toward the second position.
Figure 15:
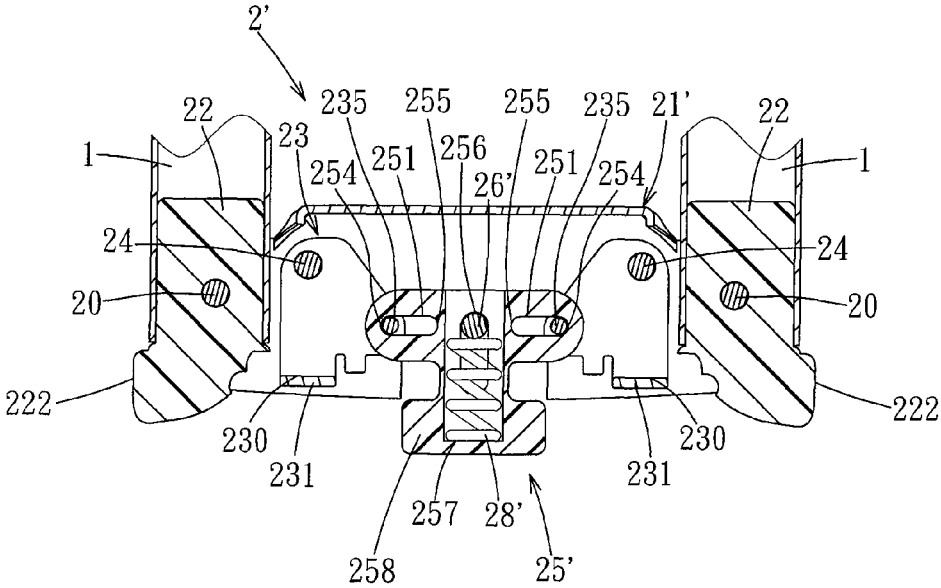
FIG. 15 is another view similar to FIG. 12, but illustrating each of the coupling components at the second position.

As best shown in FIGS. 13 to 15, when the operating portion 258 of the linking component 25' is pressed to move the linking component 25' in a direction (VI) (as indicated by the arrow in FIG. 13), the linking component 25' is moved from the initial position to the operated position through guidance of the component mounting pin 26', such that each of the coupling pins 235 is driven to move in the respective one of the guide holes 251 in the linking component 25' from the first hole end 254 toward the second hole end 255, thereby driving the locking components 23 to pivot respectively about the pivot pins 24 in directions (I) (as indicated by the arrows in FIG. 13) from the locking position to the unlocking position. Therefore, the rod coupling components 22 are permitted to pivot respectively about the pivot axles 20 in directions (II) (as indicated by the arrows in FIG. 14) from the first position to the second position, and the user can move the frame rods 1 from the unfolded state to the folded state. When the frame rods 1 are at the folded state and the linking component 25' is released, the restoring force of the biasing member 28 biases the linking component 25' back to the initial position, thereby driving the locking components 23 to move back to the locking position.

Figure 16:
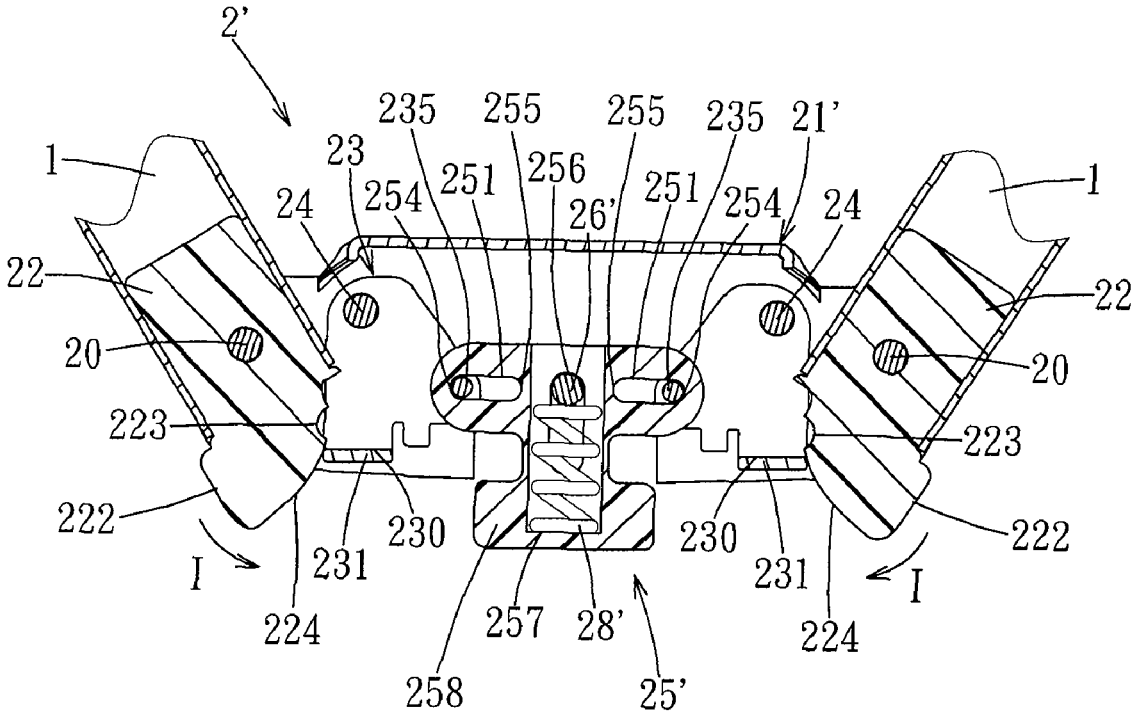
FIG. 16 is a view similar to FIG. 15, but illustrating each of the coupling components moved from the second position toward the first position.

When the user moves the frame rods 1 from the folded state to the unfolded state, as best shown in FIGS. 15 and 16, the rod coupling components 22 are moved respectively along with the frame rods 1 from the second position to the first position in the directions (I) (as indicated by arrows in FIG. 16), and the cam surface 224 of each of the rod coupling components 22 abuts slidably against the connecting plate 231 of the respective one of the locking components 23 for driving the respective one of the locking components 23 to move from the locking position to the unlocking position, thereby moving the linking component 25' to the operated position and compressing the biasing member 28'. When the rod coupling components 22 are moved back to the first position, the recess 223 in each of the rod coupling components 22 holds the respective one of the pivot pins 24, and the cam surface 224 of each of the rod coupling components 22 separates from the connecting plate 231 of the respective one of the locking components 23. Afterward, the restoring force of the biasing member 28 biases the linking component 25' to the initial position, thereby driving the locking components 23 back to the locking position. The second preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A coupling device adapted to be connected foldably to a pair of frame rods of a baby crib frame structure, each of the frame rods having a connecting end, said coupling device comprising:

a coupling seat;

a pair of rod coupling components, each of which is adapted to be connected to the connecting end of a respective one of the frame rods, said rod coupling components being coupled movably to said coupling seat and being movable relative thereto between a first position corresponding to an unfolded state of the frame rods, and a second position corresponding to a folded state of the frame rods;

a pair of locking components connected pivotally to said coupling seat and movable relative to said coupling seat between a locking position, where each of said locking components prevents movement of a respective one of said rod coupling components from the first position to the second position, and an unlocking position, where each of said locking components permits movement of the respective one of said rod coupling components from the first position to the second position; and a release unit including a linking component extending between said locking components and formed with two spaced apart elongated guide holes that are respectively adjacent to said locking components, a pair of coupling pins each extending through and being movable along a respective one of said guide holes and being connected to a respective one of said locking components, said linking component being movable relative to said coupling seat from an initial position to an operated position, where said linking component drives movement of said locking components through said coupling pins from the locking position to the unlocking position, and a biasing member for biasing said linking component to the initial position, wherein each of said rod coupling components has a contact surface, and each of said locking components has a connecting plate that is formed with an abutment surface for abutting against said contact surface of the respective one of said rod coupling components to lock the respective one of said rod coupling components at the first position when said locking component is at the locking position, wherein said coupling seat is provided with a pair of pivot pins for connecting pivotally and respectively said locking components to said coupling seat, each of said rod coupling components further having a recess that is formed at one end opposite to said contact surface thereof for holding removably a respective one of said pivot pins when said rod coupling components are at the first position.

2. A coupling device adapted to be connected foldably to a pair of frame rods of a baby crib frame structure, each of the frame rods having a connecting end, said coupling device comprising:

a coupling seat;

a pair of rod coupling components, each of which is adapted to be connected to the connecting end of a respective one of the frame rods, said rod coupling components being coupled movably to said coupling seat and being movable relative thereto between a first position corresponding to an unfolded state of the frame rods, and a second position corresponding to a folded state of the frame rods;

a pair of locking components connected pivotally to said coupling seat and movable relative to said coupling seat between a locking position, where each of said locking components prevents movement of a respective one of said rod coupling components from the first position to the second position, and an unlocking position, where each of said locking components permits movement of the respective one of said rod coupling components from the first position to the second position; and a release unit including a linking component extending between said locking components and formed with two spaced apart elongated guide holes that are respectively adjacent to said locking components, a pair of coupling pins each extending through and being movable along a respective one of said guide holes and being connected to a respective one of said locking components, said linking component being movable relative to said coupling seat from an initial position to an operated position, where said linking component drives movement of said locking components through said coupling pins from the locking position to the unlocking position, and a biasing member for biasing said linking component to the initial position, wherein said coupling seat is provided with a button mounting pin, and said release unit further includes a button component movable along said button mounting pin for driving movement of said linking component from the initial position to the operated position.

3. The coupling device as claimed in claim 2, wherein each of said coupling pins extends along a first direction, said linking component is movable relative to said coupling seat along a second direction transverse to the first direction, and each of said guide holes extends along a third direction transverse to the first and second directions.

4. The coupling device as claimed in claim 1, wherein each of said rod coupling components has a cam surface that abuts slidably against said connecting plate of the respective one of said locking components for driving the respective one of said locking components to move away from the locking position when said rod coupling components are moved from the second position to the first position.

5. The coupling device as claimed in claim 2, wherein said linking component is formed with a first inclined surface, and said button component has a second inclined surface that abuts slidably against said first inclined surface such that movement of said button component along said button mounting pin results in movement of said linking component between the initial and operated positions.

6. The coupling device as claimed in claim 2, wherein said biasing member has opposite ends abutting respectively against said coupling seat and said linking component, said release unit further including an urging member having opposite ends abutting respectively against said coupling seat and said button component.

7. The coupling device as claimed in claim 6, wherein said urging member is a coil spring sleeved on said button mounting pin.

8. The coupling device as claimed in claim 2, wherein said coupling seat is provided with a pair of pivot axles for connecting pivotally and respectively said rod coupling components to said coupling seat.

9. The coupling device as claimed in claim 2, wherein each of said guide holes has opposite first and second hole ends, said first hole ends of said guide holes being distal from each other, said second hole ends of said guide holes being proximate to each other, said coupling pins being disposed in said first hole ends of said guide holes when said linking component is at the initial position.

* * * * *